US010932079B2

(12) United States Patent
Welti

(10) Patent No.: US 10,932,079 B2
(45) Date of Patent: Feb. 23, 2021

(54) ACOUSTICAL LISTENING AREA MAPPING AND FREQUENCY CORRECTION

(71) Applicant: HARMAN INTERNATIONAL INDUSTRIES, INCORPORATED, Stamford, CT (US)

(72) Inventor: Todd S. Welti, Thousand Oaks, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 93 days.

(21) Appl. No.: 16/266,737

(22) Filed: Feb. 4, 2019

(65) Prior Publication Data

US 2020/0252738 A1 Aug. 6, 2020

(51) Int. Cl.

| | |
|---|---|
| ***H04S 7/00*** | (2006.01) |
| ***H04R 3/00*** | (2006.01) |
| ***H04R 5/02*** | (2006.01) |

(52) U.S. Cl.

CPC ..... *H04S 7/303* (2013.01); *H04R 3/005* (2013.01); *H04R 5/02* (2013.01); *H04S 7/301* (2013.01)

(58) Field of Classification Search

CPC ..... H04S 7/301; H04S 7/303; H04R 3/005; H04R 5/02; H04R 2499/11; H03G 9/14; H03G 2201/508

See application file for complete search history.

(56) References Cited

U.S. PATENT DOCUMENTS

| | | | | |
|---|---|---|---|---|
| 2007/0116306 | A1* | 5/2007 | Riedel | H04S 7/303 381/303 |
| 2010/0290643 | A1* | 11/2010 | Mihelich | H04S 7/301 381/99 |
| 2012/0058782 | A1* | 3/2012 | Li | H04W 4/029 455/456.2 |
| 2014/0270187 | A1 | 9/2014 | Hall et al. | |
| 2014/0270188 | A1* | 9/2014 | Hall | H04S 7/303 381/17 |
| 2015/0010169 | A1* | 1/2015 | Popova | H03G 3/20 381/107 |
| 2017/0195815 | A1 | 7/2017 | Christoph et al. | |

FOREIGN PATENT DOCUMENTS

WO 2011139502 A1 11/2011

* cited by examiner

*Primary Examiner* — Davetta W Goins
*Assistant Examiner* — Daniel R Sellers
(74) *Attorney, Agent, or Firm* — Brooks Kushman P.C.

(57) ABSTRACT

A smart speaker device for acoustical listening area mapping and frequency correction includes a non-transitory storage configured to maintain a listening area response map indicating filter settings corresponding to each of a plurality of locations within a listening area, a microphone array, a loudspeaker; and a controller. The controller is programmed to execute a frequency correcting application to identify a current location of a mobile device in the listening area based on ultrasonic audio received to the microphone array from the mobile device, access the listening area response map to retrieve filter settings corresponding to the current location, and apply the filter settings to an audio stream to be output to the loudspeaker to correct for frequency response of the loudspeaker at the current location of the mobile device.

18 Claims, 6 Drawing Sheets

ACOUSTICAL LISTENING AREA MAPPING AND FREQUENCY CORRECTION

TECHNICAL FIELD

Aspects of the disclosure generally relate to acoustical listening area mapping and frequency correction.

BACKGROUND

Due to room modes and other acoustic effects, frequency response of a speaker in a room or other listening area can vary greatly as the listener moves around. These deviations in frequency response can cause large differences in perceived balance of the speaker, as well as boomy resonances at various frequencies.

SUMMARY

In one or more illustrative examples, a smart speaker device for acoustical listening area mapping and frequency correction includes a non-transitory storage configured to maintain a listening area response map indicating filter settings corresponding to each of a plurality of locations within a listening area, a microphone array, a loudspeaker, and a controller. The controller is programmed to execute a frequency correcting application to identify a current location of a mobile device in the listening area based on ultrasonic audio received to the microphone array from the mobile device, access the listening area response map to retrieve filter settings corresponding to the current location, and apply the filter settings to an audio stream to be output to the loudspeaker to correct for frequency response of the loudspeaker at the current location of the mobile device.

In one or more illustrative embodiments, a smart speaker device for acoustical listening area mapping and frequency correction includes a non-transitory storage configured to maintain a listening area response map indicating filter settings corresponding to each of a plurality of locations within a listening area, a microphone array, a loudspeaker, and a controller. The controller is programmed to execute a frequency correcting application to identify a current location of a mobile device in the listening area based on ultrasonic audio received to the microphone array from the mobile device, output frequency test audio from the loudspeaker to be received by the mobile device, receive, from the mobile device, information indicative of room response at the current location, generate a room correction for the current location according to the information indicative of the room response, the room correction indicating filter settings for the current location, and update the listening area response map to indicate the filter settings as corresponding to the current location.

In one or more illustrative embodiments, a method for acoustical listening area mapping and frequency correction includes identifying a current location of a mobile device in a listening area based on ultrasonic audio received to a microphone array of a smart speaker device from the mobile device; accessing a listening area response map stored to a memory of the smart speaker device to retrieve filter settings corresponding to the current location, the listening area response map indicating filter settings corresponding to each of a plurality of locations within a listening area; and applying the filter settings to an audio stream to be output to a loudspeaker of the smart speaker device to correct for frequency response of the loudspeaker at the current location of the mobile device.

DETAILED DESCRIPTION

Figure 1:
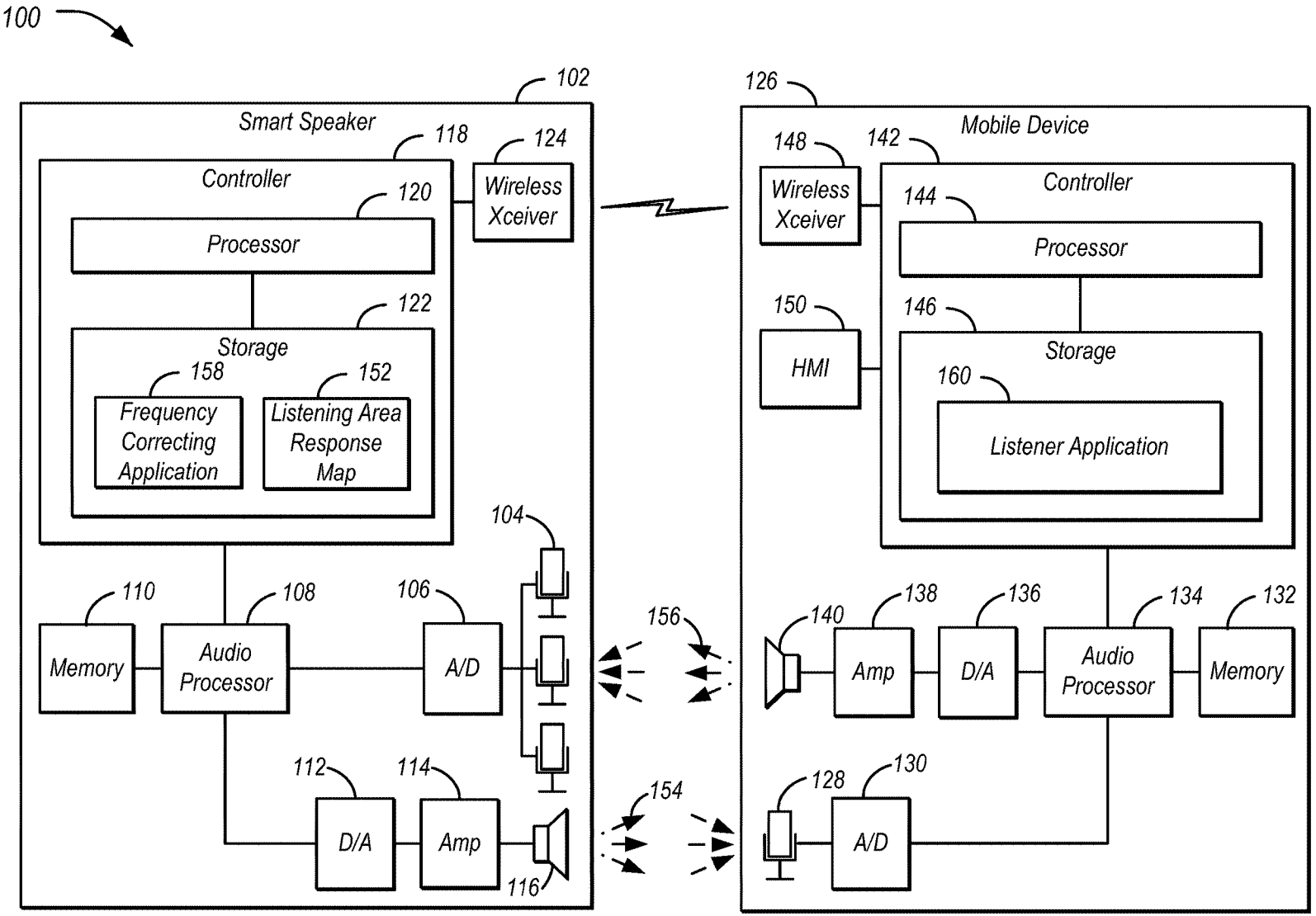
FIG. 1 illustrates a system including a smart speaker and a mobile device, configured for acoustical listening area mapping and frequency correction.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Cell phones are capable of producing audio frequencies in the ultrasonic region. This is evidenced by the fact that young kids have been known to use specialized ultrasonic ring tones that adults cannot hear. A smart speaker may utilize a microphone array to better locate users and adaptively beam-form to increase signal to noise for speech recognition. These arrays could be used to locate a person on a continuous basis (e.g., not only while they are speaking) via ultrasound.

An application installed to a user's phone or other mobile device may be programmed to cause the device to emit short ultrasound pulses at short intervals. An application installed to the smart speaker may then monitor these signals and determine the user's location via triangulation using the microphone array. The ultrasonic signal may be well-suited to precise determination of arrival times due to its short wavelength. In situations where the ultrasound is occluded by objects and/or the user's own body, the smart speaker may default to generic (unspecified) location equalization. To avoid audibility of the ultrasound signal, the emitted pulses may be very short, and only emitted when music or other audio is being played (to mask the sound). Further, the pulses may be emitted responsive to detected movement of the mobile device, so if there is no change in position the locating sounds may not be required.

During setup of the smart speaker in a listening area, the application installed to the smart speaker may be programmed to cause the smart speaker to emit a low-frequency test signal using one or more loudspeakers of the smart speaker device. A connected measurement application on the mobile device measures the low frequency response of the speaker in the listening area, as the user moves the mobile device to various locations that the user is likely to occupy in the listening area. Simultaneously, the above described triangulation method may be used to locate the user and create a "map" of the listening area, i.e., a low frequency response for each location in the listening area (or at least each location that the user is likely to be in). As one possible optimization, during the learning phase the user may spend more time in the locations that he/she is more likely to inhabit, thus weighting the generic solution to be a better compromise. Once the learning is complete, a corresponding correction map may be calculated by the smart speaker, which results in optimized low frequency response at all locations in the listening area. The smart speaker may also calculate a weighted average of the most likely positions and use that to make the best possible correction for instances where location of the user by the smart speaker is inconclusive.

At runtime, the ultrasonic triangulation component runs, allowing the smart speaker to know where the user currently is located in the listening area. Using the previously-generated listening area correction map from the learning phase, the smart speaker may determine the best correction to be applied. This filter may be applied in real-time to whatever the user is listening to on the smart speaker. If the person moves, the filter may be updated, and the update may be performed gradually to avoid detection. In instances where triangulation is not working or produces inconclusive results, perhaps due to occlusion of the source or other reason, the listening area correction defaults to a generic solution which is based on the measurements at all locations. Thus, optimization of smart speaker frequency response can be performed for a user to allow for optimized and constant sound as the user moves about the listening area, without requiring additional hardware be added to the smart speaker or mobile device.

FIG. 1 illustrates a system 100 including a smart speaker 102 and a mobile device 126, configured for acoustical listening area mapping and frequency correction. The smart speaker 102 receives audio through a microphone array 104 or other audio input, and passes the audio through an analog to digital (A/D) converter 106 to be identified or otherwise processed by an audio processor 108. The audio processor 108 also generates audio output, which may be passed through a digital to analog (D/A) converter 112 and amplifier 114 for reproduction by one or more loudspeakers 116 of the smart speaker 102. The smart speaker 102 also includes a controller 118 connected to the audio processor 108 configured to maintain a listening area response map 152 and execute a frequency correcting application 158. Based on the input audio by the audio processor 108, the controller 118 in a learning mode uses the loudspeakers 116 to play frequency test audio 154 to be received by the mobile device 126 and create the listening area response map 152 of equalizations for corresponding locations responsive to results of the frequency test included in a wireless signal received to a wireless transceiver 124 of the smart speaker 102 from the mobile device 126. In a playback mode, the controller 118 determines the current location of the user responsive to receipt of a high-frequency audio output 156 received from the mobile device 126 and directs the audio processor 108 to filter the audio signal being played back in accordance with the predetermined equalization settings for the current location identified from the listening area response map 152.

The mobile device 126 receives audio through a microphone 128 of the mobile device 126, and passes the audio through an A/D converter 130 to be identified or otherwise processed by an audio processor 134. The audio processor 134 also generates audio output, which may be passed through a D/A converter 136 and amplifier 138 for reproduction by one or more loudspeakers 140 of the mobile device 126. The mobile device 126 also includes a controller 142 connected to the audio processor 134 configured to execute a frequency correcting application 158 to determine listening area response based on the frequency test audio 154, provide the results of the frequency test in the wireless signal provided by the wireless transceiver 148. The controller 142 may also indicate the location of the mobile device 126 according to high-frequency audio output 156 sent using the loudspeakers 140 of the mobile device 126. It should be noted that the illustrated system 100 is merely an example, and more, fewer, and/or differently located elements may be used.

More specifically, the microphone array 104 may include a plurality of microphone elements arranged such that sounds in the listening area may reach the microphone elements at different times. These differences in timing may be used to determine a direction from which the sounds were received. The A/D converter 106 receives audio input signals from the microphone array 104. The A/D converter 106 converts the received signals from an analog format into a digital signal in a digital format for further processing by the audio processor 108.

While only one is shown, one or more audio processors 108 may be included in the smart speaker 102. The audio processors 108 may be one or more computing devices capable of processing audio and/or video signals, such as a computer processor, microprocessor, a digital signal processor, or any other device, series of devices or other mechanisms capable of performing logical operations. The audio processors 108 may operate in association with a memory 110 to execute instructions stored in the memory 110. The instructions may be in the form of software, firmware, computer code, or some combination thereof. The memory 110 may be any form of one or more data storage devices, such as volatile memory, non-volatile memory, electronic memory, magnetic memory, optical memory, or any other form of data storage device. In addition to instructions, operational parameters and data may also be stored in the memory 110.

The audio processor 108 may also be configured to provide an audio output signal including media content or other audio to be provided from the smart speaker 102. The audio processor 108 may also filter the audio output in accordance with filter settings received to the audio processor 108. The D/A converter 112 receives the digital output signal from the audio processor 108 and converts it from a digital format to an output signal in an analog format. The output signal may then be made available for use by the amplifier 114 or other analog components for further processing.

The amplifier 114 may be any circuit or standalone device that receives audio input signals of relatively small magnitude, and outputs similar audio signals of relatively larger magnitude. Audio input signals may be received by the amplifier 114 and output on one or more connections to the loudspeakers 116. In addition to amplification of the amplitude of the audio signals, the amplifier 114 may also include signal processing capability to shift phase, adjust frequency equalization, adjust delay or perform any other form of manipulation or adjustment of the audio signals in preparation for being provided to the loudspeakers 116. As noted above, the signal processing functionality may additionally or alternately occur within the domain of the audio processor 108. Also, the amplifier 114 may include capability to adjust volume, balance and/or fade of the audio signals provided to the loudspeakers 116. In an alternative example, the loudspeakers 116 may include the amplifier 114, such that the loudspeakers 116 are self-powered.

The loudspeakers 116 may be of various sizes and may operate over various ranges of frequencies. Each of the loudspeakers 116 may include a single transducer, or in other cases multiple transducers. The loudspeakers 116 may also be operated in different frequency ranges such as a subwoofer, a woofer, a midrange, and a tweeter. Multiple loudspeakers 116 may be included in the smart speaker 102.

The controller 118 may include various types of computing apparatus in support of performance of the functions of the smart speaker 102 described herein. In an example, the controller 118 may include one or more processors 120 configured to execute computer instructions, and a storage medium 122 on which the computer-executable instructions and/or data may be maintained. A computer-readable storage medium (also referred to as a processor-readable medium or storage 122) includes any non-transitory (e.g., tangible) medium that participates in providing data (e.g., instructions) that may be read by a computer (e.g., by the processor (s) 120). In general, a processor 120 receives instructions and/or data, e.g., from the storage 122, etc., to a memory and executes the instructions using the data, thereby performing one or more processes, including one or more of the processes described herein. Computer-executable instructions may be compiled or interpreted from computer programs created using a variety of programming languages and/or technologies including, without limitation, and either alone or in combination, JAVA, C, C++, C#, ASSEMBLY, FORTRAN, PASCAL, VISUAL BASIC, PYTHON, JAVA SCRIPT, PERL, PL/SQL, etc.

As shown, the controller 118 may include a wireless transceiver 124 or other network hardware configured to facilitate communication between the controller 118 and other networked devices. As one possibility, the wireless transceiver 124 may be a Wi-Fi transceiver configured to connect to a local-area wireless network to access a communications network. As another possibility, the wireless transceiver 124 may be a cellular network transceiver configured to communicate data over a cellular telephone network.

On the mobile device 126, the microphone 128 may provide signals based on received audio to the A/D converter 130 for conversion from an analog format into a digital signal for further processing by the audio processor 134. While only one is shown, one or more audio processor 134 may be included in the mobile device 126. As with the audio processors 108, the audio processor 134 may be one or more computing devices capable of processing audio and/or video signals, such as a computer processor, microprocessor, a digital signal processor, or any other device, series of devices or other mechanisms capable of performing logical operations. The audio processors 108 may operate in association with a memory 132 to execute instructions stored in the memory 132. The instructions may be in the form of software, firmware, computer code, or some combination thereof. The memory 132 may be any form of one or more data storage devices, such as volatile memory, non-volatile memory, electronic memory, magnetic memory, optical memory, or any other form of data storage device. In addition to instructions, operational parameters and data may also be stored in the memory 132.

The audio processor 134 may also be configured to provide an audio output signal including media content or other audio to be provided from the mobile device 126. The D/A converter 136 receives the digital output signal from the audio processor 134 and converts it from a digital format to an output signal in an analog format. Similar to as discussed with elements 114 and 116 of the smart speaker 102, the output signal may then be made available for use by the amplifier 138 or other analog components for further processing and output by the loudspeakers 140.

The controller 142 may include various types of computing apparatus in support of performance of the functions of the mobile device 126 described herein. In an example, the controller 142 may include one or more processors 144 configured to execute computer instructions, and a storage medium 146 on which the computer-executable instructions and/or data may be maintained. As shown, the controller 142 also includes a wireless transceiver 148 or other network hardware configured to facilitate communication between the controller 142 and other networked devices such as the smart speaker 102.

The mobile device 126 may also include a human machine interface (HMI) 150. In some examples, the HMI 150 may include a touchscreen display that may be used to display information and also receive user input. The HMI 150 may also include other controls and/or displays that may be used to receive user input and provide input to a user.

The listening area response map 152 is a data structure configured to store equalization information corresponding to locations within a listening area. For instance, the listening area response map 152 may indicate a low frequency response for each of a plurality of locations in the listening area. Additionally, or alternately, the listening area response map 152 may include equalization or other filter settings that may be used to correct for the low frequency response indexed to each of a plurality of locations in the listening area. The listening area response map 152 may be stored to the storage 122 of the smart speaker 102.

The frequency test audio 154 is an audio output provided by the loudspeakers 116 of the smart speaker 102 based on a frequency test signal. The frequency test signal may be a sweep, test tones, or other test signal that may be used to determine the in-room frequency response of the loudspeakers 116 at a measurement location.

The high-frequency audio output 156 is a high-frequency audio output provided by the loudspeakers 140 of the mobile device 126. The high-frequency audio output 156 may be provided in the form of one or more pulses, bursts, chirps, frequency sweeps, or other forms of audio output that may be used to determine an origination location of the high-frequency audio output 156. In many examples, the high-frequency audio output 156 may be at an ultrasonic frequency or frequencies above the hearing range of typical humans, so as to be playable without being perceived by listeners. In some cases, the high-frequency audio output 156 may be added to existing audio output of the loudspeakers 140 so as to disguise the sound of the high-frequency audio output 156.

The frequency correcting application 158 is an example of an application installed to the storage 122 of the smart speaker 102. When executed by the smart speaker 102, the frequency correcting application 158 may be programmed to cause the smart speaker 102 to perform operations of a learning mode in which the listening area response map 152 is created for a listening area, and of a playback mode in which the listening area response map 152 is used to filter the output of the smart speaker 102. Further aspects of the operation of the frequency correcting application 158 are described with respect to FIGS. 3 and 5.

The listener application 160 is an example of an application installed to the storage 146 of the mobile device 126. When executed by the mobile device 126, the listener application 160 may be programmed to cause the mobile device 126 to perform operations of a learning mode in which frequency measurements are made based on reception of the frequency test audio 154 at the microphone 128 of the mobile device 126 as well as the transmission of a signal from the mobile device 126 to the smart speaker 102 including the frequency measurements. The listener application 160 may also be programmed to cause the mobile device 126 to play the high-frequency audio output 156 via the loudspeaker 140 for reception by the microphone array 104 of the smart speaker 102 to allow the smart speaker 102 to locate the mobile device 126 in the listening area. Further aspects of the operation of the listener application 160 are described with respect to FIGS. 2 and 4.

Figure 2:
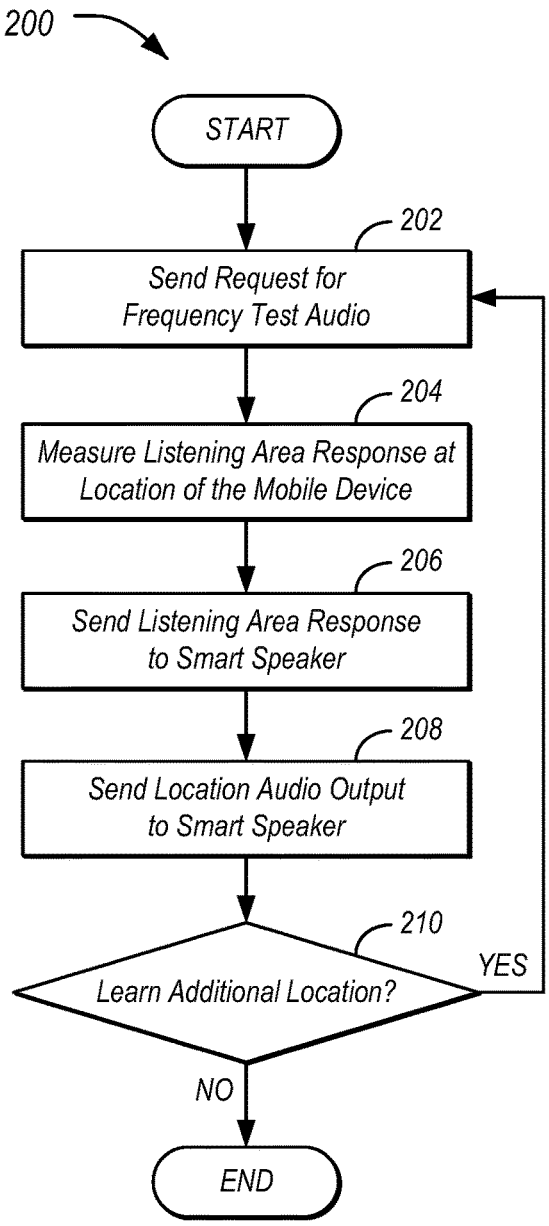
FIG. 2 illustrates an example process for operation of the mobile device in generation of the listening area response map.

FIG. 2 illustrates an example process 200 for operation of the mobile device 126 in generation of the listening area response map 152. In an example, the process 200 may be performed by execution by the mobile device 126 of the listener application 160 in a learning mode. For instance, the listener application 160 may transition to a learning mode responsive to user input to the HMI 150 of the mobile device 126 (e.g., via a menu selection), or responsive to a command to begin learning received by the mobile device 126 from the smart speaker 102 (e.g., received wirelessly via a wireless signal over WiFi or another protocol from the wireless transceiver 148 of the mobile device 126 to the wireless transceiver 124 of the smart speaker 102, encoded in an audio format and provided by the loudspeaker 116 to be received by the microphone 128 and interpreted by the mobile device 126).

At operation 202, the mobile device 126 sends a request to the smart speaker 102 to play the frequency test audio 154 via the loudspeakers 116 of the smart speaker 102. In an example, the request may be sent as a wireless signal over WiFi or another protocol from the wireless transceiver 148 of the mobile device 126 to the wireless transceiver 124 of the smart speaker 102. In another example, the request may be encoded in an audio format, and may be sent from the loudspeaker 140 to be received by the microphone array 104 of the smart speaker 102. In yet a further example, if the mobile device 126 is in the learning mode, the mobile device 126 may listen for the frequency test audio 154 and may analyze the signal once received without sending an additional request to the smart speaker 102.

At 204, the mobile device 126 measures the listening area response at the location of the mobile device 126. In an example, the frequency test audio 154 is received by the microphone 128 of the mobile device 126, which is used to record amplitude measurements for the frequencies of audio included in the frequency test audio 154 provided by the smart speaker 102. For instance, these measurements may be used to identify the low-frequency response characteristics of the location of the listening area at which the mobile device 126 is currently located.

The mobile device 126 sends the listening area response to the smart speaker 102 at 206. In an example, the listening area response may be sent as a wireless signal over WiFi or another protocol from the wireless transceiver 148 of the mobile device 126 to the wireless transceiver 124 of the smart speaker 102. In another example, the listening area response may be encoded in an audio format, and may be sent from the loudspeaker 140 to be received by the microphone array 104 of the smart speaker 102.

At operation 208, the mobile device 126 sends the high-frequency audio output 156 to be received by the smart speaker 102. In an example, the mobile device 126 may utilize the loudspeaker 140 to send the high-frequency audio output 156 to be picked up by the microphone array 104 of the smart speaker 102, to allow the smart speaker 102 to attempt to locate the mobile device 126 within the listening area. In some cases, the high-frequency audio output 156 is explicitly provided by the mobile device 126 in a predefined manner prior to, concurrent with, and/or after the sending of the listening area response data to the smart speaker 102. In another example, the high-frequency audio output 156 is provided by the mobile device 126 periodically, independent of the transmission of the listening area response to the smart speaker 102.

The mobile device 126 determines whether to learn listening area response data for an additional location at 210. In an example, the listener application 160 may provide a prompt to the HMI 150 of the mobile device 126 asking the user of the mobile device 126 whether the user has other locations within the listening area to measure. If the HMI 150 receives input indicating that additional locations are to be measured, control returns to operation 202. If not, the mobile device 126 may inform the smart speaker 102 that learning is complete (e.g., via wireless signal or audio communication), and the process 200 ends.

Figure 3:
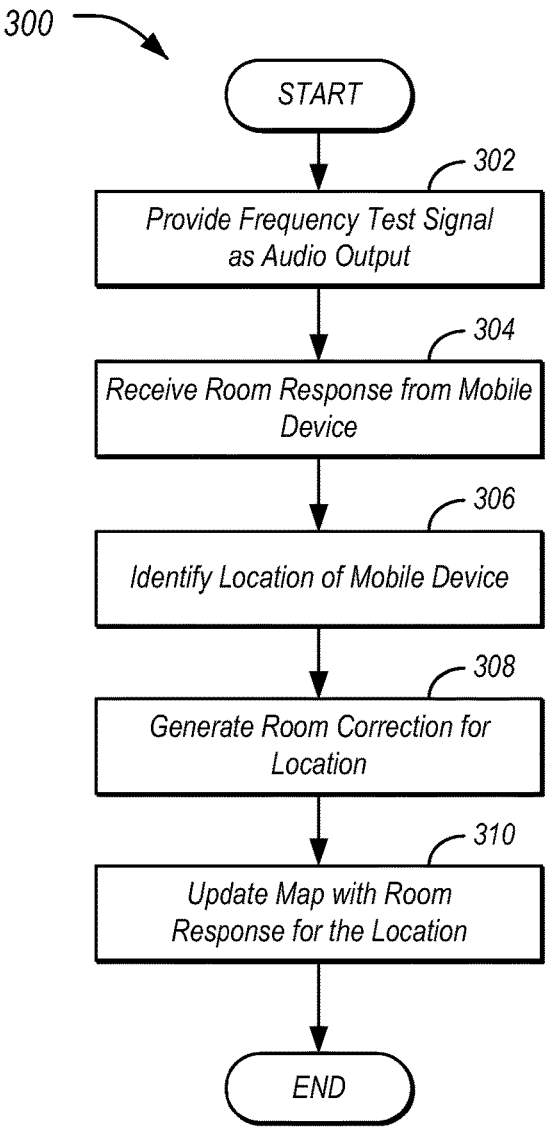
FIG. 3 illustrates an example process for operation of the smart speaker in generation of the listening area response map.

FIG. 3 illustrates an example process 300 for operation of the smart speaker 102 in generation of the listening area response map 152. In an example, the process 300 may be performed by execution by the smart speaker 102 of the frequency correcting application 158 in a learning mode.

At operation 302, the smart speaker 102 provides a frequency test signal as an audio output. In an example, the smart speaker 102 plays the frequency test audio 154 via the loudspeakers 116 of the smart speaker 102 responsive to receipt of the request at operation 202. In another example, the smart speaker 102 plays the frequency test audio 154 responsive to an indication to check response at a different location (e.g., such as discussed at operation 210), or automatically responsive to entering learning mode).

The smart speaker 102 receives room response information from the mobile device 126 at operation 304. In an example, the smart speaker 102 receives the information sent at operation 206 of the process 200.

At 306, the smart speaker 102 identifies a location of the mobile device 126. In an example, the smart speaker 102 receives the high-frequency audio output 156 sent at operation 208 of the process 200, and uses the high-frequency audio output 156 to determine a location of the mobile device 126. For instance, the smart speaker 102 may utilize time and phase differences in the signals received from each of the microphones of the microphone array 104 to calculate an angle of incidence of received audio to the microphone array 104. It should be noted that identifying the actual location of the mobile device 126 within the listening area is not critical. Instead, it is more important for the location determination to be repeatable, so that the mapping of the location can be used to identify later instances where the mobile device 126 is at the same location.

At operation 308, the smart speaker 102 generate a room correction for the identified location of the mobile device 126. In an example, the room correction may be determined as filters to be applied to audio output to reduce nonlinearities in response in the room response information received at operation 304. As one possibility, the room correction may be determined as an equalization in the form of an inverse of the differences in the room response information compared to a target response (e.g., a flat response, a target equalization, etc.). As another possibility, the room correction may be determined as a set of one or more parametric filters, which each include a frequency center point, a gain (positive or negative), and a Q which determines how wide or narrow the filter is. For instance, the frequency correcting application 158 may define one or more parametric EQ settings using an algorithm designed to minimize difference between the measured response and the target response.

At 310, the smart speaker 102 updates the listening area response map 152. In an example, the smart speaker 102 saves the room correction determined at operation 308 indexed according to the location determined at operation 306. After operation 310, the process 300 ends.

Figure 4:
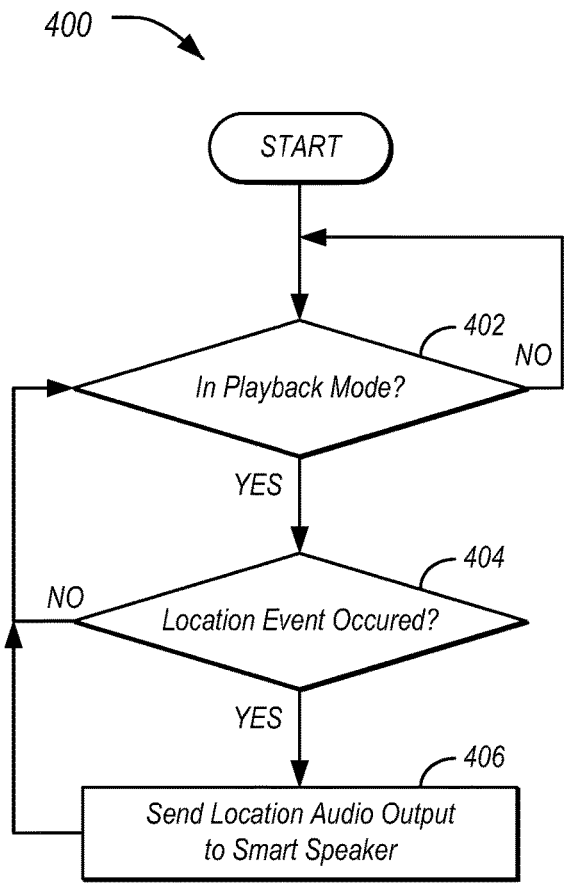
FIG. 4 illustrates an example process for the operation of the mobile device to send location updates to the smart speaker.

FIG. 4 illustrates an example process 400 for the operation of the mobile device 126 to send location updates to the smart speaker 102. In an example, the process 400 may be performed by execution by the mobile device 126 of the listener application 160 in a playback mode.

At 402, the mobile device 126 determines whether the mobile device 126 is in playback mode. In an example, the playback mode may be entered responsive to a user of the mobile device 126 requesting (e.g., via the HMI 150) for the mobile device 126 to play back audio content. The payback mode may be exited responsive to completion of the playback. In another example, the mobile device 126 may determine the smart speaker 102 to be in playback mode if the smart speaker 102 is not identified as being in the learning mode discussed in detail above. If the smart speaker 102 is in playback mode, control passes to operation 404. Otherwise, control remains at operation 402.

At operation 404, the mobile device 126 determines whether an event occurred to cause the mobile device 126 to send a location update. For instance, the listener application 160 may send location updates periodically, and may accordingly determine to send an update responsive to expiration of a timer. In another example, the listener application 160 may additionally or alternately send location updates responsive to identifying movement of the mobile device 126. For instance, the mobile device 126 may include one or more accelerometers that provide signals indicative of acceleration of the mobile device 126 in one or more directions. If one or more such events have occurred, control passes to operation 406.

At 406, similar to as discussed above with respect to operation 208 of the process 200, the mobile device 126 sends the high-frequency audio output 156 to be received by the smart speaker 102. This update may be used to allow the smart speaker 102 to track the location of the mobile device 126 and therefore the location of the user of the mobile device 126. After operation 406, the process 400 continues to operation 402.

Figure 5:
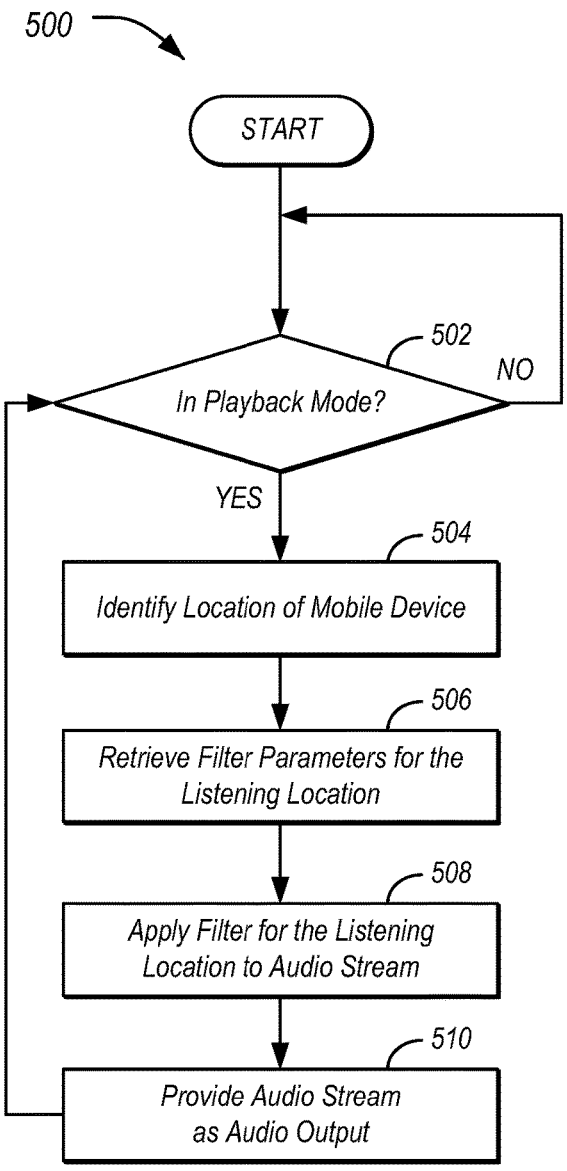
FIG. 5 illustrates an example process for the operation of the smart speaker to filter audio output in accordance with the location of the mobile device.

FIG. 5 illustrates an example process 500 for the operation of the smart speaker 102 to filter audio output in accordance with the location of the mobile device 126. In an example, the process 300 may be performed by execution by the smart speaker 102 of the frequency correcting application 158 in a playback mode.

At 502, the smart speaker 102 determines whether the smart speaker 102 is in playback mode. In an example, the playback mode may be entered responsive to a user of the mobile device 126 requesting (e.g., via the HMI 150) for the mobile device 126 to play back audio content. The payback mode may be exited responsive to completion of the playback. In another example, the smart speaker 102 be in playback mode if the smart speaker 102 is not identified as being in the learning mode discussed in detail above. If the smart speaker 102 is in playback mode, control passes to operation 504. Otherwise, control remains at operation 502.

The smart speaker 102 identifies a location of the mobile device 126 at 504. In an example, the high-frequency audio output 156 as received by the microphone array 104 of the smart speaker 102 may be compared with mapped locations of the listening area response map 152 saved using a process such as the processes 200 and 300.

At operation 506, the smart speaker 102 retrieves filter parameters for the listening location of the mobile device 126. For example, if a matching location is identified at operation 502, then filter settings for that location are retrieved from the listening area response map 152. If, however, a match is not identified, then other settings for the location may be used. For instance, the smart speaker 102 may utilize an average of the filter parameters across all locations of the listening area response map 152.

At 508, the smart speaker 102 applies the filter parameters for the listening location to an audio stream. At 510, the smart speaker 102 provides the audio stream to loudspeakers 116 of the smart speaker 102 to generate audio output. Accordingly, the audio output of the smart speaker 102 may be filtered according to the current location of the mobile device 126. After operation 508, control returns to operation 502.

Figure 6:
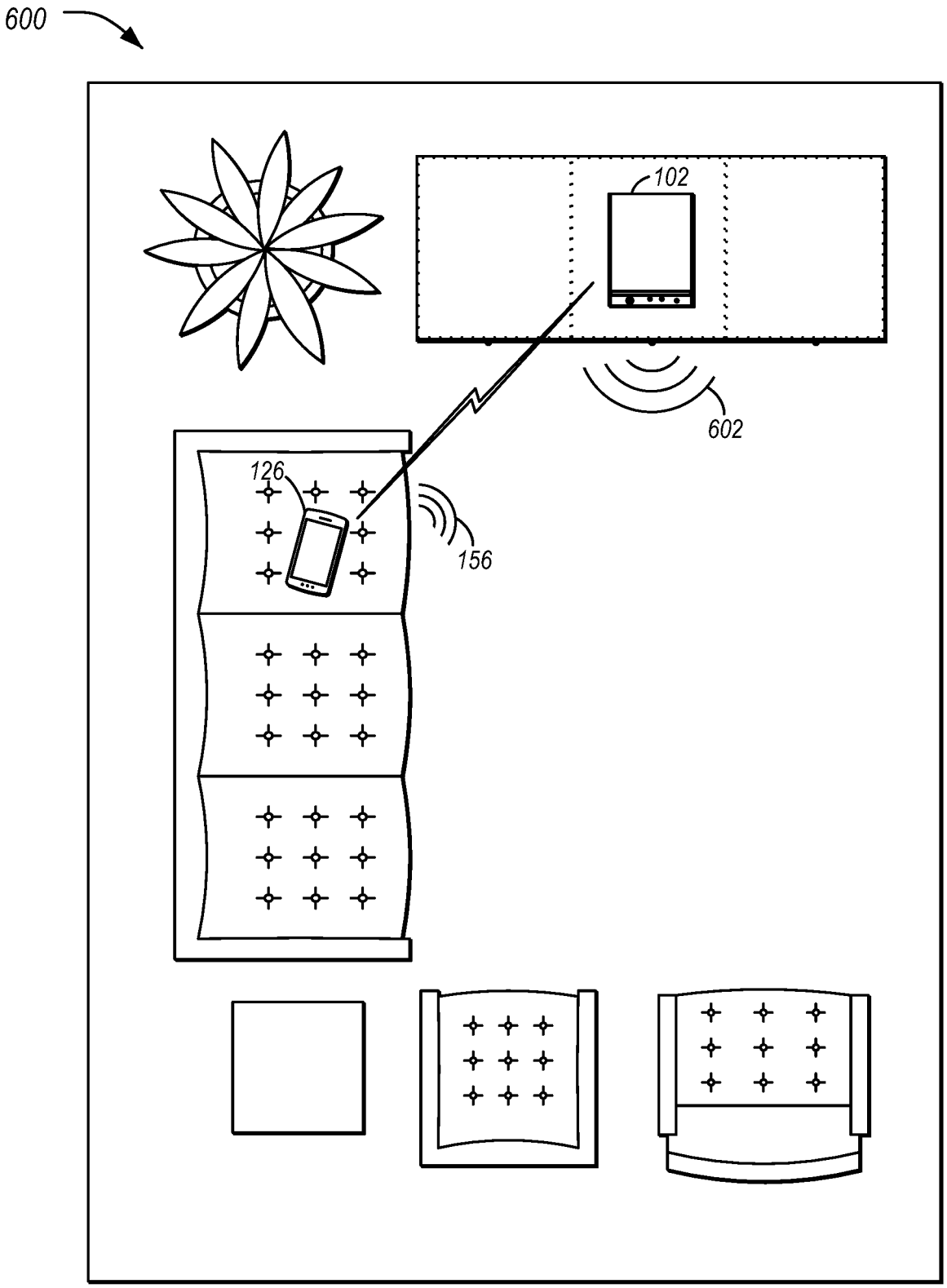
FIG. 6 illustrates an example diagram of the smart speaker filtering audio output for a mobile device at a first location in a listening area.

FIG. 6 illustrates an example diagram 600 of the smart speaker 102 filtering audio output for a mobile device 126 at a first location in a listening area. As shown, the mobile device 126 is located at the first location in the listening area and sends the high-frequency audio output 156 that allows the smart speaker 102 to identify the mobile device 126 as being located at the first location. Responsive to the identification, the smart speaker 102 uses the listening area response map 152 to filter audio output 602 provided by the smart speaker 102 in accordance with the filtering associated with the first location.

Figure 7:
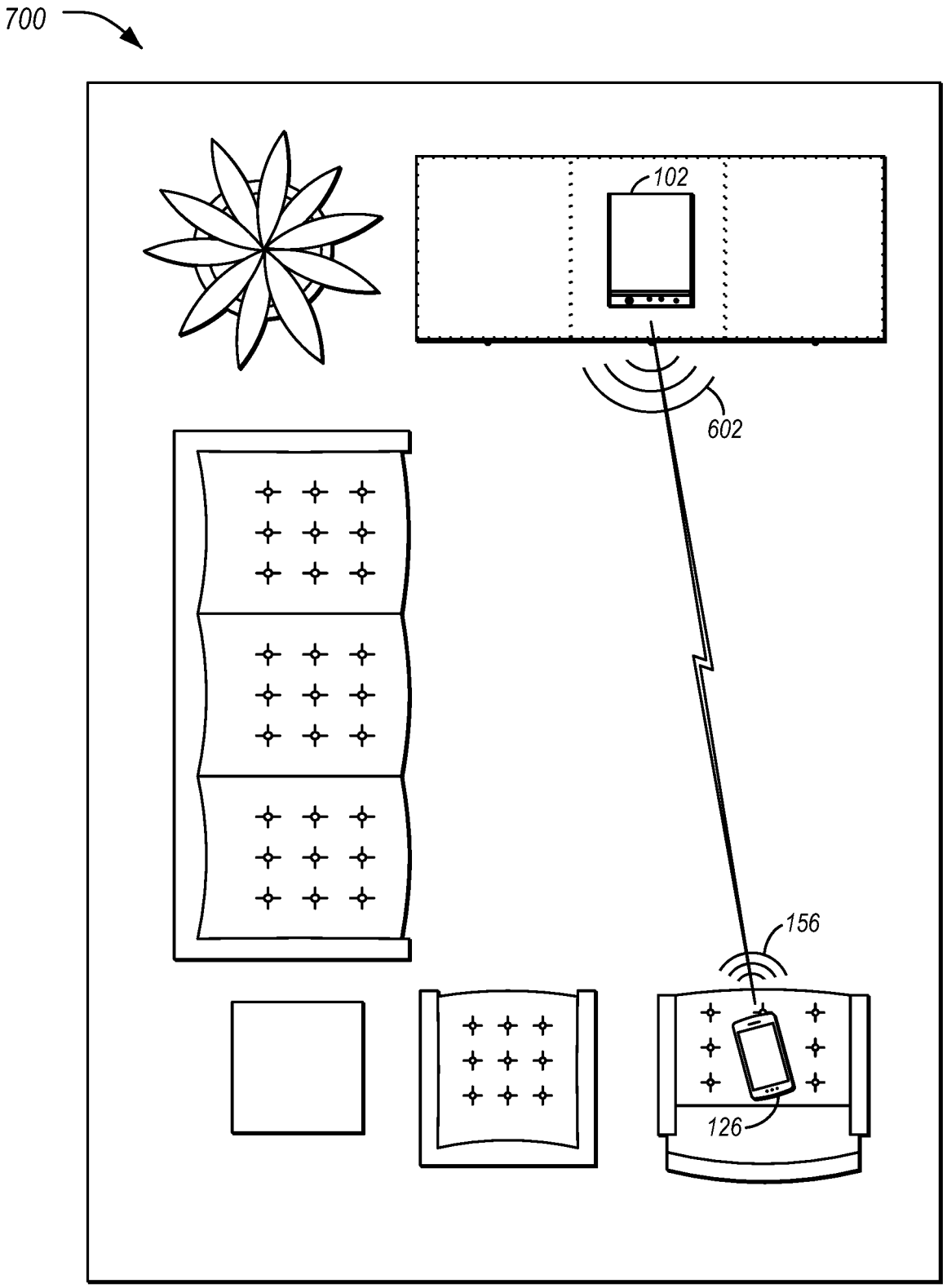
FIG. 7 illustrates an example diagram of the smart speaker filtering audio output for a mobile device at a second location in a listening area.

FIG. 7 illustrates an example diagram 700 of the smart speaker 102 filtering audio output for a mobile device 126 at a second location in a listening area. As shown, the mobile device 126 is now located at the second location in the listening area. Using the high-frequency audio output 156 from the mobile device 126, the smart speaker 102 now identifies that the mobile device 126 as located at the second location, and uses the listening area response map 152 to filter the audio output 602 in accordance with the filtering associated with the second location.

Figure 8:
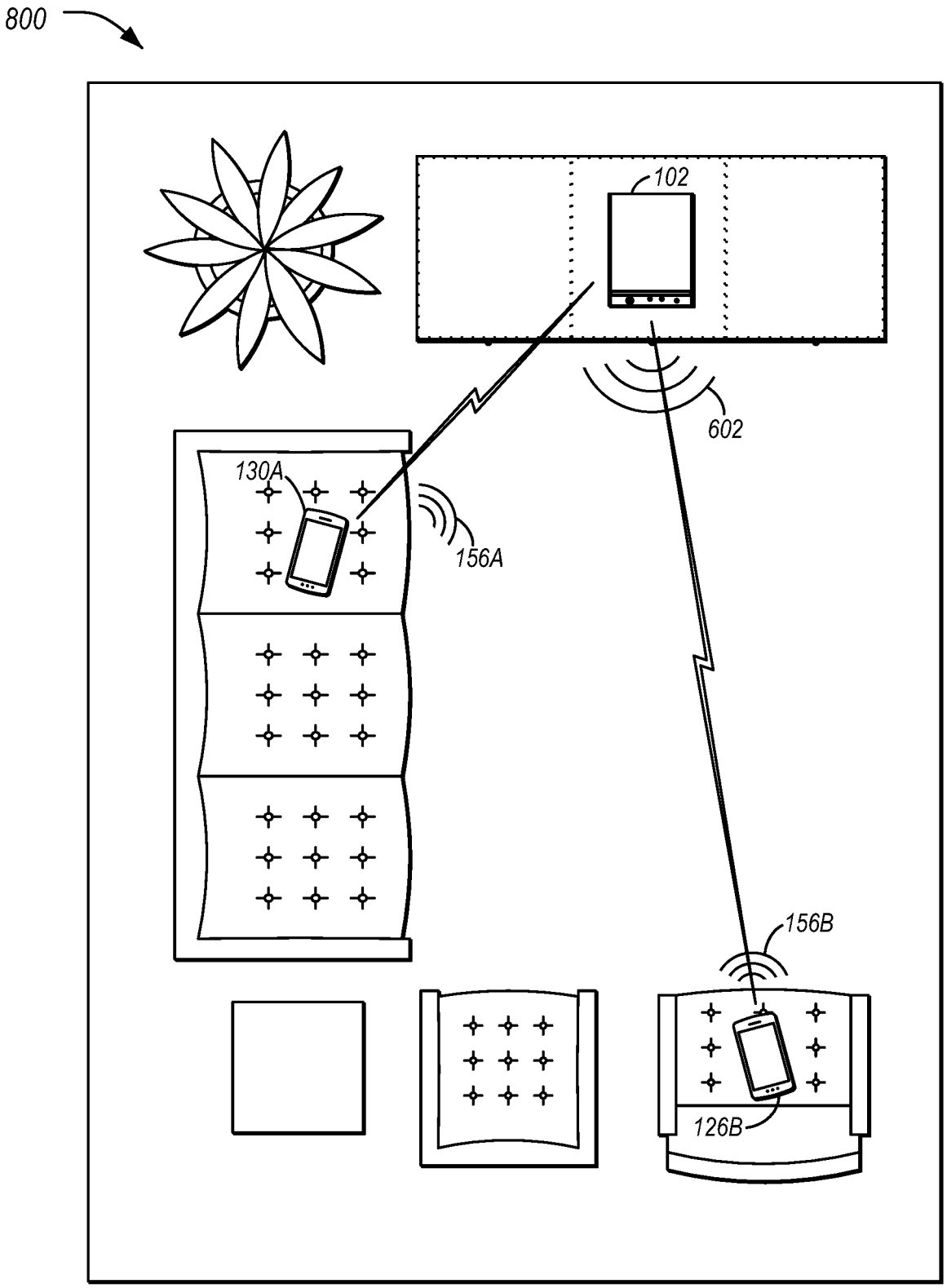
FIG. 8 illustrates an example diagram of the smart speaker filtering audio output for multiple mobile devices.

FIG. 8 illustrates an example diagram 800 of the smart speaker 102 filtering audio output for multiple mobile devices 126A and 126B. Notably, the mobile device 126A is located at the first location, while the mobile device 126B is located at the second location. Using the high-frequency audio output 156A from the mobile device 126A and the high-frequency audio output 156B from the mobile device 126B, the smart speaker 102 identifies that the mobile device 126A is located at the first location and the mobile device 126B is located at the second location. Accordingly, since the smart speaker 102 cannot apply both the filter for the first location and the filter for the second location simultaneously, the smart speaker 102 may instead provide a combined filter, such as an average of the equalization for the first and second locations. Or, the smart speaker 102 may provide a default equalization, which, for example, may be an average of all equalizations for the listening are as recorded in the response map 152.

Other variations on the system 100 are possible as well. For instance, in determining an average equalization, the system 100 may weigh the equalizations for the amount of time that a user spends in various locations within the listening area when determining an average equalization. For instance, if a user spends 60% of his time at one location and 40% at a second location, if the location of the user cannot be determined, then the smart speaker 102 may utilize an average equalization that is a weighted average that is ⅗ the equalization of the first location and ⅖ the equalization of the second area.

Computing devices described herein, such as the audio processors 108, 134 and controllers 118, 142 generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, JAVA™, JAVASCRIPT, C, C++, C#, VISUAL BASIC, JAVA SCRIPT, PYTHON, PERL, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A smart speaker device for acoustical listening area mapping and frequency correction comprising:

a non-transitory storage configured to maintain a listening area response map indicating filter settings corresponding to each of a plurality of locations within a listening area;

a microphone array;

a loudspeaker; and a controller programmed to execute a frequency correcting application to:

identify a current location of a mobile device in the listening area based on ultrasonic audio received to the microphone array from the mobile device, access the listening area response map to retrieve filter settings corresponding to the current location, responsive to the current location lacking corresponding filter settings in the listening area response map or the current location being inconclusively identified, utilize a weighted average of the filter settings in the listening area response map as the filter settings to apply to the audio stream, wherein filter settings corresponding to locations that the mobile device has spent more time are given greater weight, and apply the filter settings to an audio stream to be output to the loudspeaker to correct for frequency response of the loudspeaker at the current location of the mobile device.

2. The smart speaker device of claim 1, wherein the filter settings include an equalization to adjust for differences in response of the listening area compared to a target frequency response.

3. The smart speaker device of claim 1, wherein the filter settings include a set of one or more parametric filters, each including a frequency center point of the parametric filter, a gain level for the parametric filter, and a Q indicating width of the parametric filter.

4. The smart speaker device of claim 1, wherein the current location of the mobile device is determined by triangulating the ultrasonic audio using signals received from a plurality of microphones of the microphone array.

5. The smart speaker device of claim 1, wherein the controller is further programmed to, during a learning phase:

output frequency test audio from the loudspeaker to be received by the mobile device located at the current location, receive information indicative of room response at the current location, generate a room correction for the current location according to the information indicative of the room response, the room correction indicating filter settings for the current location, update the listening area response map to indicate the filter settings as corresponding to the current location, and capture an amount of time that the mobile device is at the current location during the learning phase to use in computing a weight for the filter settings corresponding to the current location.

6. The smart speaker device of claim 1, wherein the controller is further programmed to:

identify a second current location of a second mobile device in the listening area based on second ultrasonic audio received to the microphone array from the second mobile device, access the listening area response map to retrieve second filter settings corresponding to the second current location, and apply an average of the filter settings and the second filter settings to the audio stream to be output to the loudspeaker.

7. A smart speaker device for acoustical listening area mapping and frequency correction comprising:

a non-transitory storage configured to maintain a listening area response map indicating filter settings corresponding to each of a plurality of locations within a listening area;

a microphone array;

a loudspeaker; and a controller programmed to execute a frequency correcting application to:

identify a current location of a mobile device in the listening area based on ultrasonic audio received to the microphone array from the mobile device, output frequency test audio from the loudspeaker to be received by the mobile device, receive, from the mobile device, information indicative of room response at the current location, capture an amount of time that the mobile device is at the current location to use in computing a weight for the filter settings corresponding to the current location, such that responsive to an identified location of the mobile device lacking corresponding filter settings in the listening area response map or the identified location being inconclusively identified, utilize a weighted average of the filter settings in the listening area response map as the filter settings to apply, wherein filter settings corresponding to locations that the mobile device has spent more time are given greater weight, generate a room correction for the current location according to the information indicative of the room response, the room correction indicating filter settings for the current location, and update the listening area response map to indicate the filter settings as corresponding to the current location.

8. The smart speaker device of claim 7, wherein the controller is further programmed to apply the filter settings to an audio stream to be output to the loudspeaker to correct for frequency response of the loudspeaker at the current location of the mobile device.

9. The smart speaker of claim 7, wherein the controller is further programmed to determine the room correction as an equalization in the form of an inverse of differences in the information indicative of the room response compared to a target response.

10. The smart speaker of claim 9, wherein the target response is a flat response.

11. The smart speaker of claim 9, wherein the target response is a predefined equalization.

12. The smart speaker of claim 7, wherein the controller is further programmed to:

identify a second current location of the mobile device in the listening area based on second ultrasonic audio received to the microphone array from the mobile device, output second frequency test audio from the loudspeaker to be received by the mobile device, receive, from the mobile device, second information indicative of room response at the second current location, generate a second room correction for the second current location according to the second information indicative of the room response, the room correction indicating second filter settings for the current location, and update the listening area response map to indicate the second filter settings as corresponding to the second current location.

13. A method for acoustical listening area mapping and frequency correction comprising:

identifying a current location of a mobile device in a listening area based on ultrasonic audio received to a microphone array of a smart speaker device from the mobile device;

accessing a listening area response map stored to a memory of the smart speaker device to retrieve filter settings corresponding to the current location, the listening area response map indicating filter settings corresponding to each of a plurality of locations within a listening area;

responsive to the current location lacking corresponding filter settings in the listening area response map, utilizing a weighted average of the filter settings in the listening area response map as the filter settings to apply, wherein filter settings corresponding to locations that the mobile device has spent more time are given greater weight; and applying the filter settings to an audio stream to be output to a loudspeaker of the smart speaker device to correct for frequency response of the loudspeaker at the current location of the mobile device.

14. The method of claim 13, wherein the filter settings include an equalization to adjust for differences in response of the listening area compared to a target frequency response.

15. The method of claim 13, wherein the filter settings include a set of one or more parametric filters, each including a frequency center point of the parametric filter, a gain level for the parametric filter, and a Q indicating width of the parametric filter.

16. The method of claim 13, wherein the current location of the mobile device is determined by triangulating the ultrasonic audio using signals received from a plurality of microphones of the microphone array.

17. The method of claim 13, further comprising:

outputting frequency test audio from the loudspeaker to be received by the mobile device located at the current location, receiving information indicative of room response at the current location, generating a room correction for the current location according to the information indicative of the room response, the room correction indicating filter settings for the current location, updating the listening area response map to indicate the filter settings as corresponding to the current location, and capturing an amount of time that the mobile device is at the current location during a learning phase to use in computing a weight for the filter settings corresponding to the current location.

18. The method of claim 13, further comprising:

identifying a second current location of a second mobile device in the listening area based on second ultrasonic audio received to the microphone array from the second mobile device;

accessing the listening area response map to retrieve second filter settings corresponding to the second current location; and applying an average of the filter settings and the second filter settings to the audio stream to be output to the loudspeaker.

* * * * *